US006328194B1

(12) United States Patent
Meschenmoser

(10) Patent No.: US 6,328,194 B1
(45) Date of Patent: Dec. 11, 2001

(54) DEVICE FOR HANDLING A MATERIAL WEB

(75) Inventor: Andreas Meschenmoser, Horganzall (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/564,806

(22) Filed: May 5, 2000

(30) Foreign Application Priority Data

May 7, 1999 (DE) ..... 199 21 202

(51) Int. Cl.[7] ..... B65H 20/00; D21F 3/10
(52) U.S. Cl. ..... 226/95; 162/370; 162/306
(58) Field of Search ..... 226/95; 162/306, 162/360.2, 368, 369, 370, 371

(56) References Cited

U.S. PATENT DOCUMENTS

| | | | | |
|---|---|---|---|---|
| 2,714,342 | * | 8/1955 | Beachler | 162/370 |
| 2,748,671 | | 6/1956 | Heys . | |
| 2,869,437 | * | 1/1959 | Hornbostel et al. | 162/306 X |
| 3,587,962 | * | 6/1971 | Herzhoff | 226/95 |
| 3,902,960 | * | 9/1975 | Zentner | 162/370 X |
| 4,673,462 | * | 6/1987 | Laapotti | 162/306 X |
| 5,020,242 | * | 6/1991 | Mayer et al. | 162/370 X |
| 5,925,220 | * | 7/1999 | Hirsch et al. | 162/370 X |
| 6,174,414 | * | 1/2001 | Theriault | 162/369 X |

FOREIGN PATENT DOCUMENTS

| | | |
|---|---|---|
| 4008870 | 9/1991 | (DE) . |
| 4023297 | 1/1992 | (DE) . |
| 4436745 | 4/1996 | (DE) . |
| 19654282 | 6/1998 | (DE) . |
| 1476230 | 6/1977 | (GB) . |

* cited by examiner

*Primary Examiner*—Michael R. Mansen
(74) *Attorney, Agent, or Firm*—Greenblum & Bernstein P.L.C.

(57) ABSTRACT

Device for handling a material web that includes a suction roll having a perforated jacket, and a porous support belt guided over the suction roll between a take-on region and a lift-off region. A surface of the porous support belt is adapted to guide the material web and the surface adapted to guide the material web is arranged away from a surface of the suction roll. The suction roll includes suction zones adjacent to an inner side of the perforated jacket, such that a first suction zone, arranged in the take-on region, is coupled to a vacuum source, and a second suction zone, arranged in the take-off region, is coupled to the vacuum source through the first suction zone. One of an outer web holding box and a suction tube is positioned subsequent to the take-off region, relative to a web travel direction, and is arranged to be suctioned by the second suction zone.

33 Claims, 2 Drawing Sheets

DEVICE FOR HANDLING A MATERIAL WEB

CROSS-REFERENCE TO RELATED APPLICATIONS

The present application claims priority under 35 U.S.C. §119 of German Patent Application No. 199 21 202.3, filed on May 7, 1999, the disclosure of which is expressly incorporated by reference herein in its entirety.

BACKGROUND OF THE INVENTION

1. Field of the Invention

The invention relates to a device for handling a material web, such as a paper or cardboard web in particular, in which the material web is guided along with a porous support belt over a suction roll, in particular a suction roll serving as a pick-up and/or transfer roll and having a perforated jacket, with the porous support belt being located in the region of the suction roll between the suction roll and the material web.

2. Discussion of Background Information

As a rule, in conventional devices of the kind mentioned above, a separately operated web-holding suction box or suction tube is provided subsequently to the pick-up and/or transfer roll. This necessitates a correspondingly greater energy expenditure. The desired vacuum must be produced in various places, for which purpose separate blowers are used, as a rule. Moreover, this results in a greater space requirement. Thus, in addition to the greater assembly cross-section, more conduits are also necessary. Not only must an additional blower be employed, there is also an increased expenditure for conduits.

SUMMARY OF THE INVENTION

The object of the invention is to create a device of the type mentioned at the outset which can be operated while keeping the structure as simple and compact as possible and with a substantially lower energy expenditure.

This object is attained according to the invention in that the suction roll has a suction zone in the approach region and the exit region of the material web that adjoins the inner side of the perforated roll jacket, in that the suction zone provided in the approach region is connected to a vacuum source, in that an outer web holding box or suction tube directly following the exit region is provided with suction by way of the suction zone located in the exit region, and in that this suction zone, which acts upon the web holding box or suction tube and is arranged in the exit region, is supplied with vacuum by way of the suction zone provided in the approach region and connected to the vacuum source.

Due to the combination of a suction roll with a web holding box or suction tube, this construction results in an energy-saving and compact functional unit with which a closed web guide can be realized in an optimal manner following the suction roll. Not only are the web holding box or suction tube provided with suction by the conveyed vacuum of the suction roll, the conveyed vacuum also serves to prevent blisters from forming before the subsequent nip, such that a corresponding stabilizing effect is achieved at the same time. Particularly with the aid of the constantly produced evacuated cavity air at the end of the suction zone, continuing adhesion of the web to the porous support belt is thus ensured. At the same time, a sound insulation is achieved at the suction roll. All in all, a cost-effective total solution results.

In a one-screen drying group described in DE 40 23 297 A1, a screen deflector roll is provided between two drying cylinders that, subsequent to an extended, continuous suction zone, has a further suction zone arranged before the exit region of the material web which can be embodied without a connection to the interior of the suction box or can be connected to the interior of the suction box by choke tubes. Neither a web holding box nor a suction tube is associated with this screen deflector roll.

In a useful practical embodiment of the device according to the invention, at least one intermediate suction zone is provided in the web travel direction between the suction zone located in the approach region of the material web and the suction zone located in the exit region of the material web. In this arrangement, the intermediate suction zone as well as the suction zone located in the exit region are supplied with vacuum by way of the suction zone located in the approach region, which is connected to the vacuum source.

More advantageously, the intermediate suction zone and/or the suction zone provided in the exit region are acted upon at least in part by the vacuum of the suction roll, which is conveyed in particular by way of the evacuated jacket holes.

In a useful practical embodiment, the suction zone provided in the approach region and the suction zone following it in the web travel direction are connected to one another by way of at least one choking point.

The porous support belt can, in particular, be formed by a felt.

In a preferred practical embodiment of the device according to the invention, the material web is removed from a felt by the suction zone of the suction roll provided in the approach region.

The suction roll can be provided between two presses, for example.

The present invention is directed to a device for handling a material web that includes a suction roll having a perforated jacket, and a porous support belt guided over the suction roll between a take-on region and a lift-off region. A surface of the porous support belt is adapted to guide the material web and the surface adapted to guide the material web is arranged away from a surface of the suction roll. The suction roll includes suction zones adjacent to an inner side of the perforated jacket, such that a first suction zone, arranged in the take-on region, is coupled to a vacuum source, and a second suction zone, arranged in the take-off region, is coupled to the vacuum source through the first suction zone. One of an outer web holding box and a suction tube is positioned subsequent to the take-off region, relative to a web travel direction, and is arranged to be suctioned by the second suction zone.

According to a feature of the invention, the suction roll can be adapted as at least one of a pick-up roll and a transfer roll. Further, the material web can include one of a paper and a cardboard web.

In accordance with another feature of the invention, the suction roll can further include at least one intermediate suction zone located between the first and the second suction zones in the web travel direction, and the at least one intermediate suction zone can be coupled to the vacuum source through the first suction zone.

According to another feature of the invention, at least one of the at least one intermediate suction zone and the second suction zone can be at least partially supplied with a vacuum conveyed through the evacuated holes in the perforated jacket.

In accordance with still another feature of the present invention, the first suction zone and the at least one intermediate suction zone can be arranged adjacent each other in the web travel direction through at least one variable choking point.

Further, the at least one intermediate suction zone and the second suction zone may be arranged adjacent each other in the web travel direction through at least one variable choked connection.

Moreover, the first, second, and at least one intermediate suction zones can each be formed as suction chambers which open to the inner side of the perforated jacket.

The device may also include sealing strips extending parallel to a roll axis and located between a stationary suction box and an inner side of the perforated jacket. The sealing strips may be arranged to define the first, second, and at least one intermediate suction zones in an inner circumferential direction of the suction roll by the sealing strips. A gap can be located between at least one of the sealing strips and the roll jacket to form a choking point, and the choking point can be positioned to couple the first suction zone to the at least one intermediate suction zone in the web travel direction.

In accordance with a further feature of the instant invention, the web holding box can be basin shaped.

According to a still further feature of the invention, a sealing element can be provided. The web holding box can have an opening coupled to the suction roll and the sealing element may be arranged to define the opening at least essentially to the second suction zone.

According to still another feature of the present invention, one of a non-contacting seal and a lip seal can be provided. A region between the web holding box and the porous support belt may be sealed at an end of the web holding box, relative to the web travel direction, by the one of the non-contacting seal and the lip seal.

An underpressure forming in the web holding box can be adjustable via a vacuum braker. The vacuum braker can include a vacuum choke.

Further, the web holding box can include a waste water outlet located in a lower region, and the waste water outlet is coupled to a discharge line. The discharge line can be adapted to empty into a surge tank located at a level below the waste water outlet.

In accordance with another feature of the present invention, the porous support belt can include a felt.

According to still another feature of the instant invention, approaching the take-on region, the material web can be guided between a felt and the porous support belt, and the material web can be separated from the felt by the first suction zone.

In accordance with a further feature of the invention, the suction roll can be located between two press device. The two press devices can be composed of shoe presses.

The instant invention is directed to a device for handling a material web that includes a suction roll having a perforated jacket, and a porous support belt being guided over the suction roll between a take-on region and a lift-off region. The suction roll can include at least a first and second suction zone in a belt travel direction. A vacuum source is provided, in which the first suction zone is coupled to the vacuum source, and the second suction zone is coupled to the vacuum source through the first suction zone. A web holding box is coupled to the second suction zone, such that the web holding box is coupled to the vacuum source through the first and the second suction zones.

In accordance with a feature of the invention, the suction roll may further include a stationary suction box, in which the first suction zone can be coupled to the stationary suction box and the second suction zone can be located between the stationary suction box and the perforated roll jacket. Further, the second suction zone can be defined by at least two seals located between the stationary suction box and the perforated roll jacket, and the at least two seals can extend parallel to a roll axis. At least one of the at least two seals can be located at a choking point.

According to still another feature of the instant invention, at least one intermediate suction zone can be located between the first suction zone and the second suction zone in a belt run direction, such that the at least one intermediate suction zone can be coupled to the vacuum source through the first suction zone. The suction roll may further include a stationary suction box, wherein the first suction zone can be coupled to the stationary suction box, and wherein the second and the at least one intermediate suction zone can be located between the stationary suction box and the perforated roll jacket. Further, the second and the at least one intermediate suction zones may each be defined by at least two seals located between the stationary suction box and the perforated roll jacket, and the at least two seals can extend parallel to a roll axis. One of the seals located between the first suction zone and the at least one intermediate suction zone can be located at a choking point, and another of the seals located between the at least one intermediate suction zone and the second suction zone can be located at another choking point.

In accordance with yet another feature of the present invention, the web holding box can include a surface adapted to suction the perforated support belt after the lift-off region, relative to the belt travel direction. The web holding box can include an opening adapted to an outside surface of the suction roll and coupled to the second suction zone. Further, the web holding box may include a sealing element adapted to adjust the opening to the second suction zone. The web holding box can also include a seal located at an end of the surface adapted to suction the porous support belt after the lift-off region opposite the suction roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
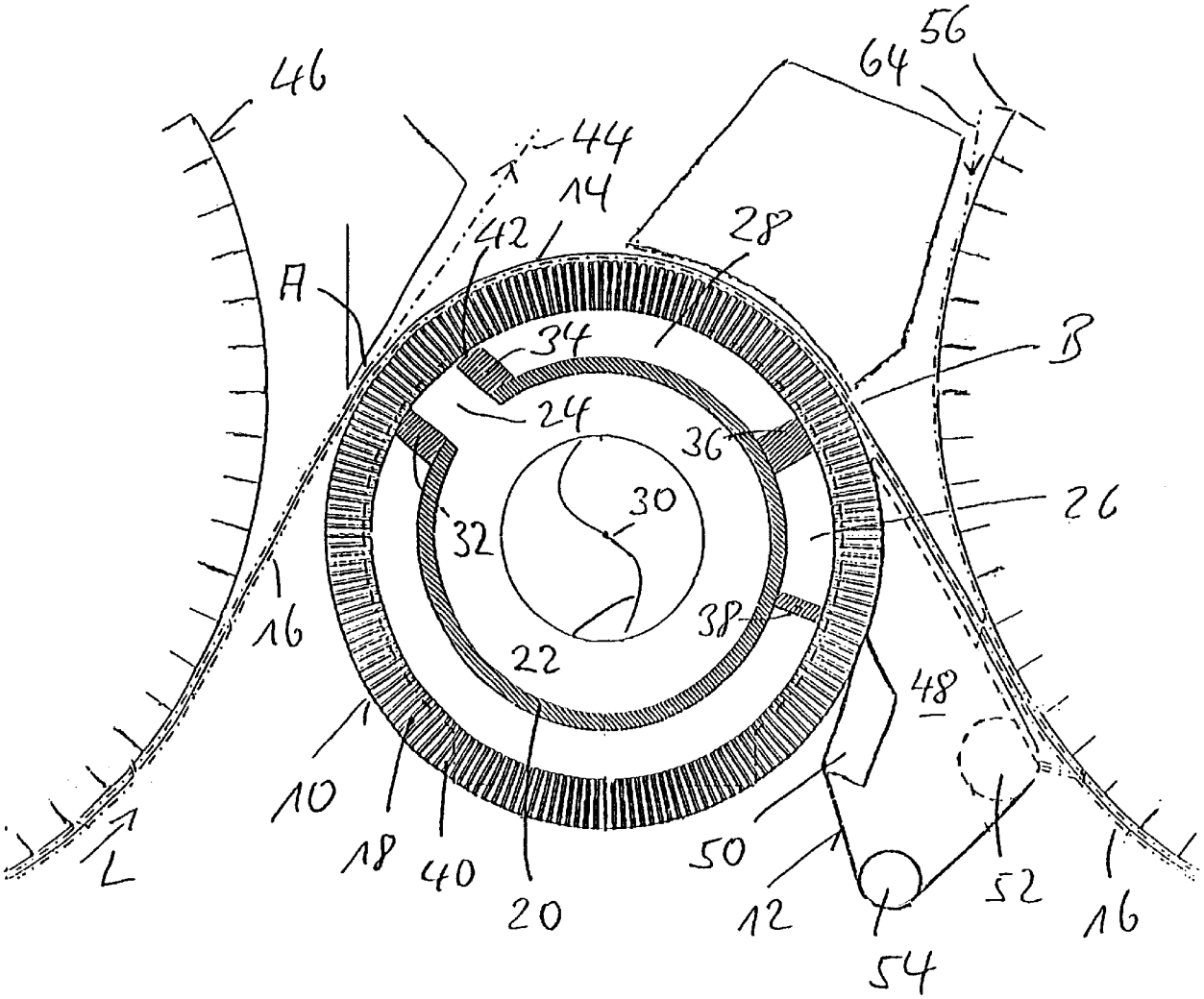
FIG. 1 a schematic, partially sectioned view of a transfer suction roll with an associated web holding box.

FIG. 1 shows a schematic, partially sectioned view of a transfer suction roll 10 with a web holding box 12 associated therewith. The functional unit formed thereby is part of a device for handling a material web 14 which can, in particular, be a paper or cardboard web.

Here, the material web 14 is guided along with a porous support belt, here a felt 16, over the transfer suction roll 10 which, in particular, also serves as a pick-up roll.

Inside the perforated jacket 18 of the transfer suction roll 10, a stationary suction box 20 is arranged whose interior is connected to a vacuum source which, for example, can include a blower 22.

The transfer suction roll 10 has a suction zone 24 or 26 in the approach region A as well as in the exit region B of the material web 14 and/or of the felt 16 lying between the material web 14 and the transfer suction roll 10, the suction zones 24 and 26 are adjacent to the inner side of the perforated roll jacket 18 and a further suction zone 28 can be provided therebetween.

The suction zones 24, 26, 28 are each delimited in the inner circumferential direction of the transfer suction roll 10 by sealing strips 32–38 which extend parallel to the roll axis 30 and are located between the stationary suction box 20 and the inner side of the roll jacket 18. The suction zones 24,26,28 are each constructed as suction chambers that are open to the inner side of the perforated roll jacket.

The outer web holding box 12 arranged subsequently to the exit region B is provided with suction by way of the suction zone 26 provided in the exit region B.

Of the three suction zones 24, 26, 28, only the suction zone 24 provided in the approach region A is directly connected to the interior of the stationary suction box 20 and therefore to the vacuum source 22. The intermediate suction zone 28 and the suction zone 26 provided in the exit region B of the material web 14 are thus supplied with vacuum from the suction chamber 24 provided in the approach region A and connected to the vacuum source 22. The suction zones 26 and 28, which are arranged behind the suction zone 24 in the web travel direction L, are correspondingly acted upon at least in part by the conveyed vacuum, which is conveyed in particular by way of the evacuated jacket holes 40 of the roll jacket 18.

Thus, the entire vacuum is primarily connected directly to the suction zone 24 provided in the approach region A. However, the suction zone 24 provided in the approach region A and the intermediate suction zone 28 following it in the web travel direction L can be connected to one another by way of a choking point 42 which, in the present case, is formed in that a corresponding gap is left between the applicable axial sealing strip 34 and the roll jacket 18. In this context, a variable choking point can be provided, for example. In principle, it is also possible to provide a preferably variable connection between the suction zone 26 provided in the exit region B and the intermediate suction zone 28 preceding it. Several such choking points can also be provided.

In the present case, the material web 14 is removed from a felt 44 by the suction zone 24 provided in the approach region A of the transfer suction roll 10, which felt is previously guided around a roll 46 which can be associated with a press, for example. The intermediate suction zone 28 serves to hold the material web 14 that has been removed from the felt 44 against the felt 16 guided over the transfer suction roll 10.

All of the vacuum produced by the vacuum source 22 is thus primarily directly connected to the suction zone 24 provided in the approach region A.

After the material web 14 has been taken over by the transfer suction roll 10 in the region of the suction zone 24, the permeability of the felt 16 is abruptly reduced over the suction zone 24, by which an active vacuum is produced in the intermediate suction zone 28. In this process, the intermediate suction zone 28 and the suction zone 26 provided in the exit region B can be at least partially supplied with a corresponding vacuum by the conveyed vacuum, which is conveyed by the evacuated jacket holes in particular. Here, the air-permeability of the felt 16 as well as of the material web 14 is of particular significance.

Moreover, both suction zones 24 and 28 are connected to one another by way of the choking point 42 in the present instance. In particular, this choking point 42 can also be variable. In principle, another choked and/or chokable connection can be provided between the two suction zones 24 and 28. It is also possible in principle to provide at least one connection that is preferably also variable and, in particular, choked, between the suction zone 26 provided in the exit region B and the intermediate suction zone 28 directly preceding it.

The suction zone 26 provided in the exit region B which, in the present case, begins just following this exit region B, serves to use the vacuum that has been conveyed by way of the evacuated jacket holes 40 and is released after the third sealing strip 36 in order to produce the necessary underpressure in the interior of the web holding box 12 so that a separate suctioning of the web holding box 12 is no longer necessary. For this purpose, the fourth sealing strip 38 must be provided. At the same time, the additional chamber-like suction zone 26 formed thereby, along with the nearly closed inner chamber 48 of the web holding box 12, has the effect of a noise reduction chamber. The suction zone 26 can, in principle, also begin before the exit region B. Then, in order to act upon the web holding box 12, it extends a corresponding distance past this exit region B.

The web holding box 12 is constructed in the shape of a basin and open in the direction of the transfer suction roll 10, with the applicable opening region delimited by a seal 50 such as, e.g., a doctor that can be pressed with pressurized air onto the region of the associated suction zone 26 of the transfer suction roll 10.

The region between the web holding box 12 and the felt 16 carrying the material web 14 is sealed on the back end in the web travel direction L of the web holding box 12 by a seal 52, which can be a non-contacting seal or a lip seal. A non-contacting seal can, e.g., be achieved along the lines of a blade of air by blowing air diagonally against the felt. A sliding plastic lamella which conforms to the felt 16 is conceivable as a lip seal.

On the faces, the inner chamber 48 of the web holding box 12 can be sealed off in a contact-free manner from the felt 16 and/or the transfer suction roll 10 with a small gap or, as an alternative, e.g., with a blade of air.

The underpressure forming in the web holding box 12 can, for example, be adjustable by way of a vacuum breaker such as, in particular, a vacuum choke or the like.

The web holding box 12 can be provided in its lower region with a waste water outflow 54 to which, for example, an outlet line or an outlet tube can be assigned which empties into a surge tank or a siphon arranged at a lower level so that the underpressure forming in the inner chamber 48 of the web holding box 12 is maintained. If the inner chamber 48 of the web holding box 12 is connected to a vacuum breaker such as, in particular, a vacuum choke or the like, this underpressure can be adjusted at will.

According to FIG. 1, the material web 14 being supported by the felt 16 is finally guided to a roll 56 which is looped around by a felt 64 and, like the roll 46, can be again associated with a press, for example.

Figure 2:
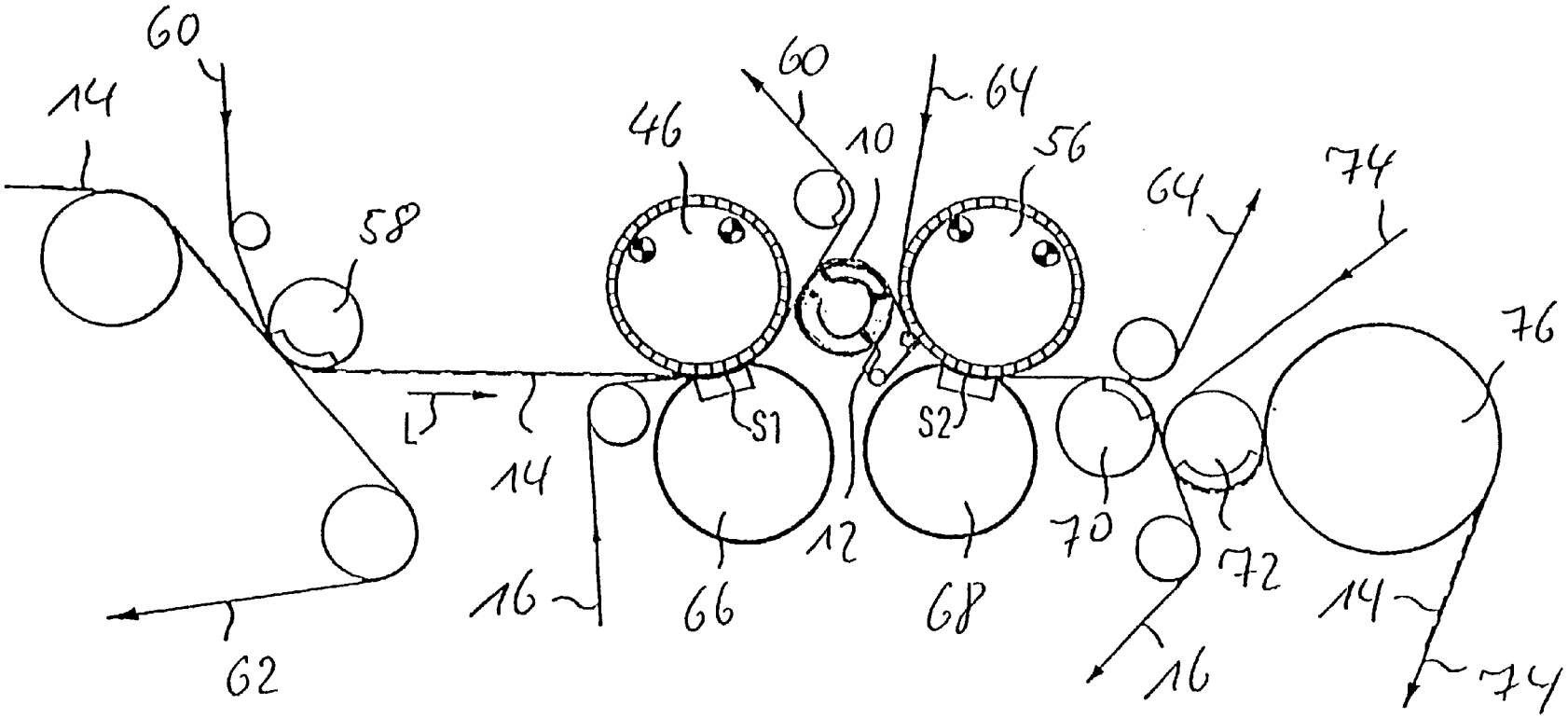
FIG. 2 a schematic, partially sectioned view of a press arrangement with two shoe presses, between which a functional unit including a transfer suction roll and a web holding box according to FIG. 1 is employed.

FIG. 2 shows a schematic, partially sectioned view of a press arrangement with two shoe presses, between which the functional unit including the transfer suction roll 10 and the web holding box 12 according to FIG. 1 is arranged.

In this press arrangement, the material web 14 is taken over from a wire belt 62 by an upper felt 60 in the region of a suction roll 58 and subsequently guided, along with a lower felt 16, to a first press nip S1 elongated in the web travel direction L. Subsequently, the material web 14 is guided along with the lower felt 16 over the transfer suction roll 10 and thereupon is guided to a second press nip S2 elongated in the web travel direction L.

As can be seen from FIG. 2, both of the press nips S1 and S2 elongated in the web travel direction L are formed by two separate, neighboring shoe presses, each comprising a lower shoe press unit 66 and 68 and an upper opposing roll 46 and 56.

Subsequent to the second press nip S2 elongated in the web travel direction L, the material web 14 is preferably guided over a deflection roll 70 that is embodied as a suction roll and, in the region of another deflection roll 72, which is also embodied as a suction roll, taken over by a drying wire 74 and guided to the first drying cylinder 76 of a drying section.

After the material web 14 is guided along with the lower felt 16 around the transfer suction roll 10 subsequent to the first elongated press nip S1 and then for a distance along the web holding box 12, in the region of which it is suctioned through the felt 16, a completely closed web guide results from the material web 14 being taken over by the upper felt 60 of the wire belt 62, with the upper felt simultaneously serving as a pick-up felt, until the transfer of the web to the drying section.

An upper felt 64 is guided around the opposing roll 56 of the second shoe press 56, 68 so that both shoe presses 46, 66 and 56, 68 are each felted on both sides. Subsequent to the second elongated press nip S2, the material web 14 is separated again from the upper felt 64 in the region of the deflection roll 70 embodied as a suction roll.

As can be seen from FIG. 2, the web holding box 12 is arranged after the transfer suction roll 10 and between the suction roll 10 and the opposing roll 56 of the following shoe press 56, 68.

In the present case of a press arrangement with two shoe press units 66 and 68 lying below, the material web 14 is thus guided along with the lower felt 16, which is guided through both shoe presses, over the transfer suction roll 10 and the web holding box 12.

However, press arrangements are also conceivable which result from the press arrangement described above being mirrored around its vertical and/or horizontal axis, for example. In the horizontally mirrored variant, an upper felt (pick-up felt) would be guided through both press nips as a tandem felt.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for handling a material web, comprising:

a suction roll having a perforated jacket;

a porous support belt guided over said suction roll between a take-on region and a lift-off region, wherein a surface of said porous support belt is adapted to guide the material web and said surface adapted to guide the material web is arranged away from a surface of said suction roll;

said suction roll comprising suction zones adjacent to an inner side of said perforated jacket, wherein a first suction zone, arranged in said take-on region, is coupled to a vacuum source, and a second suction zone, arranged in said take-off region, is coupled to said vacuum source through said first suction zone; and one of an outer web holding box and a suction tube positioned subsequent to said take-off region, relative to a web travel direction, and arranged to be suctioned by said second suction zone.

2. The device in accordance with claim 1, wherein said suction roll is adapted as at least one of a pick-up roll and a transfer roll.

3. The device in accordance with claim 2, wherein the material web comprises one of a paper and a cardboard web.

4. The device in accordance with claim 1, said suction-roll further comprising at least one intermediate suction zone located between said first and said second suction zones in the web travel direction, said at least one intermediate suction zone being coupled to said vacuum source through said first suction zone.

5. The device in accordance with claim 4, wherein at least one of said at least one intermediate suction zone and said second suction zone are at least partially supplied with a vacuum conveyed through evacuated holes in said perforated jacket.

6. The device in accordance with claim 4, wherein said first suction zone and said at least one intermediate suction zone are arranged adjacent each other in the web travel direction through at least one variable choking point.

7. The device in accordance with claim 4, further comprising sealing strips extending parallel to a roll axis and located between a stationary suction box and an inner side of said perforated jacket, wherein said sealing strips are arranged to define said first, second, and at least one intermediate suction zones in an inner circumferential direction of said suction roll by said sealing strips.

8. The device in accordance with claim 7, wherein a gap is located between at least one of said sealing strips and said inner side of said perforated jacket to form a choking point, said choking point being positioned to couple said first suction zone to said at least one intermediate suction zone in the web travel direction.

9. The device in accordance with claim 1, wherein said at least one intermediate suction zone and said second suction zone are arranged adjacent each other in the web travel direction through at least one variable choked connection.

10. The device in accordance with claim 1, wherein said first, second, and at least one intermediate suction zones are each formed as suction chambers which open to the inner side of said perforated jacket.

11. The device in accordance with claim 1, wherein said web holding box is basin shaped.

12. The device in accordance with claim 1, further comprising a sealing element, wherein said web holding box has an opening coupled to said suction roll and said sealing element is arranged to define said opening at least essentially to said second suction zone.

13. The device in accordance with claim 1, further comprising one of a non-contacting seal and a lip seal, wherein a region between said web holding box and said porous support belt is sealed at an end of said web holding box, relative to the web travel direction, by said one of said non-contacting seal and said lip seal.

14. The device in accordance with claim 1, wherein an underpressure forming in said web holding box is adjustable via a vacuum braker.

15. The device in accordance with claim 14, wherein said vacuum braker comprises a vacuum choke.

16. The device in accordance with claim 1, wherein said web holding box comprises a waste water outlet located in a lower region, and said waste water outlet is coupled to a discharge line.

17. The device in accordance with claim 16, wherein said discharge line is adapted to empty into a surge tank located at a level below said waste water outlet.

18. The device in accordance with claim 1, wherein said porous support belt comprises a felt.

19. The device in accordance with claim 1, further comprising a felt, wherein, approaching said take-on region, the material web is guided between said felt and said porous support belt, and said material web is separated from said felt by said first suction zone.

20. The device in accordance with claim 1, further comprising two press devices, wherein said suction roll is located between said two press devices.

21. The device in accordance with claim 20, wherein said two press devices are composed of shoe presses.

22. A device for handling a material web, comprising:

a suction roll having a perforated jacket;

a porous support belt being guided over said suction roll between a take-on region and a lift-off region;

said suction roll comprising at least a first and second suction zone in a belt travel direction;

a vacuum source, wherein said first suction zone is coupled to said vacuum source, and said second suction zone is coupled to said vacuum source through said first suction zone; and a web holding box coupled to said second suction zone, wherein said web holding box is coupled to said vacuum source through said first and said second suction zones.

23. The device in accordance with claim 22, said suction roll further comprising a stationary suction box, wherein said first suction zone is coupled to said stationary suction box and said second suction zone is located between said stationary suction box and said perforated roll jacket.

24. The device in accordance with claim 23, wherein said second suction zone is defined by at least two seals located between said stationary suction box and said perforated roll jacket, said at least two seals extending parallel to a roll axis.

25. The device in accordance with claim 24, wherein at least one of said at least two seals is located at a choking point.

26. The device in accordance with claim 22, further comprising at least one intermediate suction zone located between said first suction zone and said second suction zone in a belt run direction, wherein said at least one intermediate suction zone is coupled to said vacuum source through said first suction zone.

27. The device in accordance with claim 26, said suction roll further comprising a stationary suction box, wherein said first suction zone is coupled to said stationary suction box, and wherein said second and said at least one intermediate suction zone is located between said stationary suction box and said perforated roll jacket.

28. The device in accordance with claim 27, wherein said second and said at least one intermediate suction zones are each defined by at least two seals located between said stationary suction box and said perforated roll jacket, said at least two seals extending parallel to a roll axis.

29. The device in accordance with claim 28, wherein one of said seals located between said first suction zone and said at least one intermediate suction zone is located at a choking point, and wherein another of said seals located between said at least one intermediate suction zone and said second suction zone is located at another choking point.

30. The device in accordance with claim 22, wherein said web holding box comprises a surface adapted to suction said porous support belt after said lift-off region, relative to the belt travel direction.

31. The device in accordance with claim 30, said web holding box comprising an opening adapted to an outside surface of said suction roll and coupled to said second suction zone.

32. The device in accordance with claim 31, said web holding box comprising a sealing element adapted to adjust said opening to said second suction zone.

33. The device in accordance with claim 32, said web holding box further comprising a seal located at an end of said surface adapted to suction said porous support belt after said lift-off region opposite said suction roll.

* * * * *